US008844548B2

(12) United States Patent
Soletski et al.

(10) Patent No.: US 8,844,548 B2
(45) Date of Patent: Sep. 30, 2014

(54) WALKING AID SUPPORT

(76) Inventors: Michael M Soletski, Green Bay, WI (US); Robert Patrick Limoni, Green Bay, WI (US)

( * ) Notice: Subject to any disclaimer, the term of this patent is extended or adjusted under 35 U.S.C. 154(b) by 0 days.

(21) Appl. No.: 13/461,681

(22) Filed: May 1, 2012

(65) Prior Publication Data

US 2013/0291913 A1 Nov. 7, 2013

(51) Int. Cl.
*A45B 9/04* (2006.01)
*A61H 3/02* (2006.01)

(52) U.S. Cl.
CPC ..... *A45B 9/04* (2013.01); *A61H 3/0288* (2013.01)
USPC ..... 135/84; 135/82; 135/77; 248/188.9

(58) Field of Classification Search
CPC ..... A45B 9/04; A61H 3/0288; A61H 3/0277; A61H 2003/0283
USPC ..... 135/65–66, 68, 70, 77, 82, 84, 86, 135/910–911; 248/188.9, 346.11, 345.1; 482/77; 16/42 R, 43; 280/813, 819, 823
See application file for complete search history.

(56) References Cited

U.S. PATENT DOCUMENTS

| | | | | | |
|---|---|---|---|---|---|
| 2,230,406 | A | * | 2/1941 | Johnson | 135/77 |
| 4,098,283 | A | * | 7/1978 | Tritle, Jr. | 135/77 |
| 4,899,771 | A | * | 2/1990 | Wilkinson | 135/77 |
| 5,103,850 | A | | 4/1992 | Davis | |
| 5,301,703 | A | | 4/1994 | Kahn | |
| 5,353,825 | A | * | 10/1994 | Davis | 135/78 |
| 5,409,029 | A | | 4/1995 | Davis | |
| D359,162 | S | * | 6/1995 | Knight | D3/17 |
| 5,465,745 | A | | 11/1995 | Davis | |
| 5,713,382 | A | | 2/1998 | Midcap | |
| 5,752,535 | A | * | 5/1998 | Sanders | 135/68 |
| 5,992,434 | A | * | 11/1999 | Berlin et al. | 135/77 |
| 6,003,533 | A | | 12/1999 | Midcap | |
| 6,374,841 | B1 | * | 4/2002 | Yamamoto et al. | 135/77 |
| 6,802,482 | B2 | * | 10/2004 | Harris | 248/188.9 |
| 6,866,338 | B2 | * | 3/2005 | Mendenhall et al. | 297/239 |
| 6,910,246 | B2 | * | 6/2005 | Desmarais | 16/42 R |
| 7,360,547 | B2 | | 4/2008 | Carlson | |
| 7,757,537 | B1 | * | 7/2010 | Hartranft | 72/458 |
| 8,408,224 | B2 | * | 4/2013 | Ozuna et al. | 135/84 |
| 2007/0277863 | A1 | * | 12/2007 | Gordon | 135/66 |
| 2009/0288693 | A1 | * | 11/2009 | Lasota | 135/86 |
| 2012/0067386 | A1 | * | 3/2012 | Giannatasio et al. | 135/84 |
| 2013/0074893 | A1 | * | 3/2013 | Palmer | 135/68 |

* cited by examiner

*Primary Examiner* — Winnie Yip
(74) *Attorney, Agent, or Firm* — Steven H. Greenfield; Greenfield Invention and Patent Consulting Inc.

(57) ABSTRACT

A support for a walking aid such as a crutch, a walker or a cane is disclosed. The support is configured for providing enhanced balance on adverse terrain that may contain obstacles and/or have slippery spots. In an embodiment of the present invention, the support comprises a flat bottom and an upwardly angled slit that provides an upper and a lower section configured for contorting in a manner as to enhance friction with the walking terrain thus reducing the probability of slippage. In an alternate embodiment, the support comprises an oval shaped bottom and a downwardly angled slit. This support is configured facilitating walking and providing support in rough terrain.

7 Claims, 10 Drawing Sheets

WALKING AID SUPPORT

FIELD OF THE INVENTION

The present invention relates to a support for a walking aid such as a crutch, a walker or a cane. The support is configured for providing enhanced balance on adverse terrain that may contain obstacles and/or have slippery spots.

BACKGROUND OF THE INVENTION

A number of prior art references describe crutch tips and related walking aids.

U.S. Pat. No. 5,409,029 discloses a crutch tip assembly having a crutch tip base with a laterally protruding lip adjacent a base bottom surface and a resilient boot having the shape of a rocker. The boot defines a mounting cavity for snugly receiving the base bottom surface and the lip for holding the boot on the base.

U.S. Pat. Nos. 6,003,533 and 5,713,382 teach an improved walking aid tip that is easy to use and provides for better support on smooth or slippery surfaces. The tip combines the features of an enlarged base for better stability on sand and gravel, a combination of convex and flat base to provide support for the user when the walking aid is positioned at a wide variety of angles with the ground surface, an enlarged rigid support member that entirely covers and supports the rubber base so that the cane is less apt to wobble, a socket, a threaded screw and a threaded screw hole to allow for easy installation of the tip.

U.S. Pat. No. 5,301,703 relates to a cane that has a tip at its bottom end in the shape of a hemispherical shell. The cane is for the use of a visually handicapped person.

U.S. Pat. No. 5,103,850 is for a crutch tip assembly comprising a solid base having substantially vertical side surfaces and outwardly, downwardly tapered front and rear surfaces with convex bottom surface forming an approximate arc elongated in a direction approximately parallel to the side surfaces.

In U.S. Pat. No. 5,465,745, an adjustable crutch includes upper and lower assemblies which are slidably interconnected with one another and constructed of hollow aluminum pipes; or tubing, interconnected by glass or fiber-reinforced nylon members.

U.S. Pat. No. 7,360,547 is for a walking assist device includes an elongate shaft having an adjustable length, a handle detachably connected to a proximal end of the elongate shaft, and a curved elongate base that matingly engages a distal end of the elongate shaft.

A deficiency of the embodiments in these prior art references is their lack of ability to balance mobility, walking steadiness and prevent tripping.

SUMMARY OF THE PRESENT INVENTION

Typical walkers, canes and crutches for handicapped persons contain a handle, a rod and a tip placed on the bottom of the rod. The handicapped persons who use these canes, walkers or crutches for walking are concerned with three hazards or situations that may cause the persons to fall and injure themselves: 1) losing balance on a slippery surface caused by the tip sliding out from underneath the person, 2) hitting an object or an obstacle on the ground with the walker causing the person to continue in motion through inertia, while the walker is stopped by the obstacle and 3) being restricted by the walker as the person moves forward or slips backward as he/she grabs onto the walker for support, but the walker is insufficiently flexible to move with the person.

The present invention provides for a walker base that addresses all three issues. A first embodiment of the present invention is configured for persons with a relatively severe handicap and limited moving dexterity generally unable to walk without a walking aid. This embodiment is configured for providing stability in bumpy or slippery walking terrains under a number of adverse situations that may occur.

A second embodiment of the present invention is configured for use by persons who are not severely handicapped and use a walking aid, possibly for optional support if, for example, one leg is sore or injured. Such a person would desire flexibility and only minimum movement restriction from the use of the walking aid.

These and other features, aspects and advantages of the present invention will become better understood with reference to the following drawings, descriptions and claims.

DETAILED DESCRIPTION OF THE INVENTION

Figure 1:
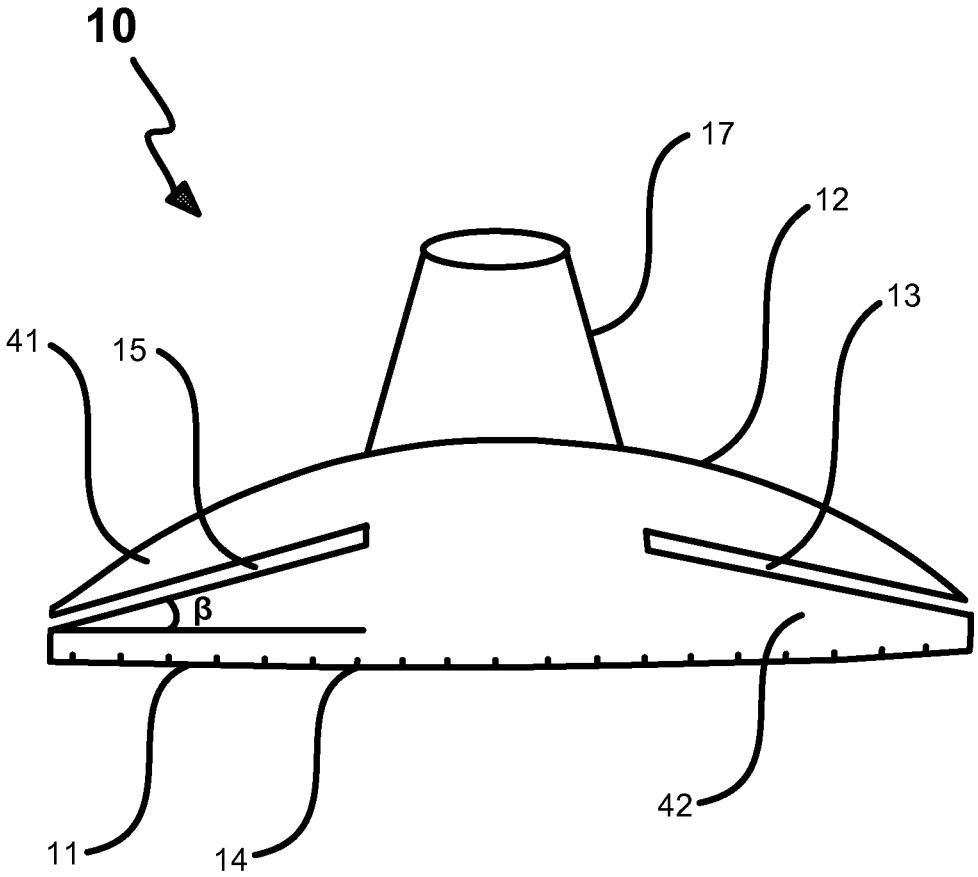
FIG. 1 is a side view of a walking aid support according to a first embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention is described in FIGS. 1-10. The first embodiment of the present invention is shown in FIGS. 1, 3, 5, 6, 7 and 9. The second embodiment is described in FIGS. 2, 3, 4, 8 and 10. The components of the first embodiment 10 of the walking aid support include a substantially rectangular and flat bottom 11, a top curved into a semi-elliptical or oval shape and a first slit 15 that starts at the front of the support block 10 and ends about a third into the interior of the support block 10. The slit 15 is angled upward forming an acute angle β relative to the flat bottom 11. The acute angle β may range from about 10 degrees to about 25 degrees and preferably from 15 degrees to about 20 degrees. The slit 15 divides the front side of the support block into a relatively rigid and thick lower section 42 and a more flexible upper section 41. The thickness of the upper section 41 is between about 20 percent and about 40 percent of the thickness of the lower section.

The bottom of the support block has threads 14 that extend longitudinally across the length of rectangular flat bottom 11 and threads 14 that extend across the width of the bottom 11. The length of the block 10 ranging from about 4.5 inches to about 5.0 inches and the width ranging from about 2.5 inches to about 3 inches provide a generally wide base for stability and balance.

The preferred material of construction is rubber; however other materials including but not limited to wood and metal also fall within the scope of the present invention. A tip 17 affixed to the top 12 of the support block 10 serves as an attaching medium for a properly shaped rod 19 that contains a handle 32 for gripping by the walking person.

Figure 6:
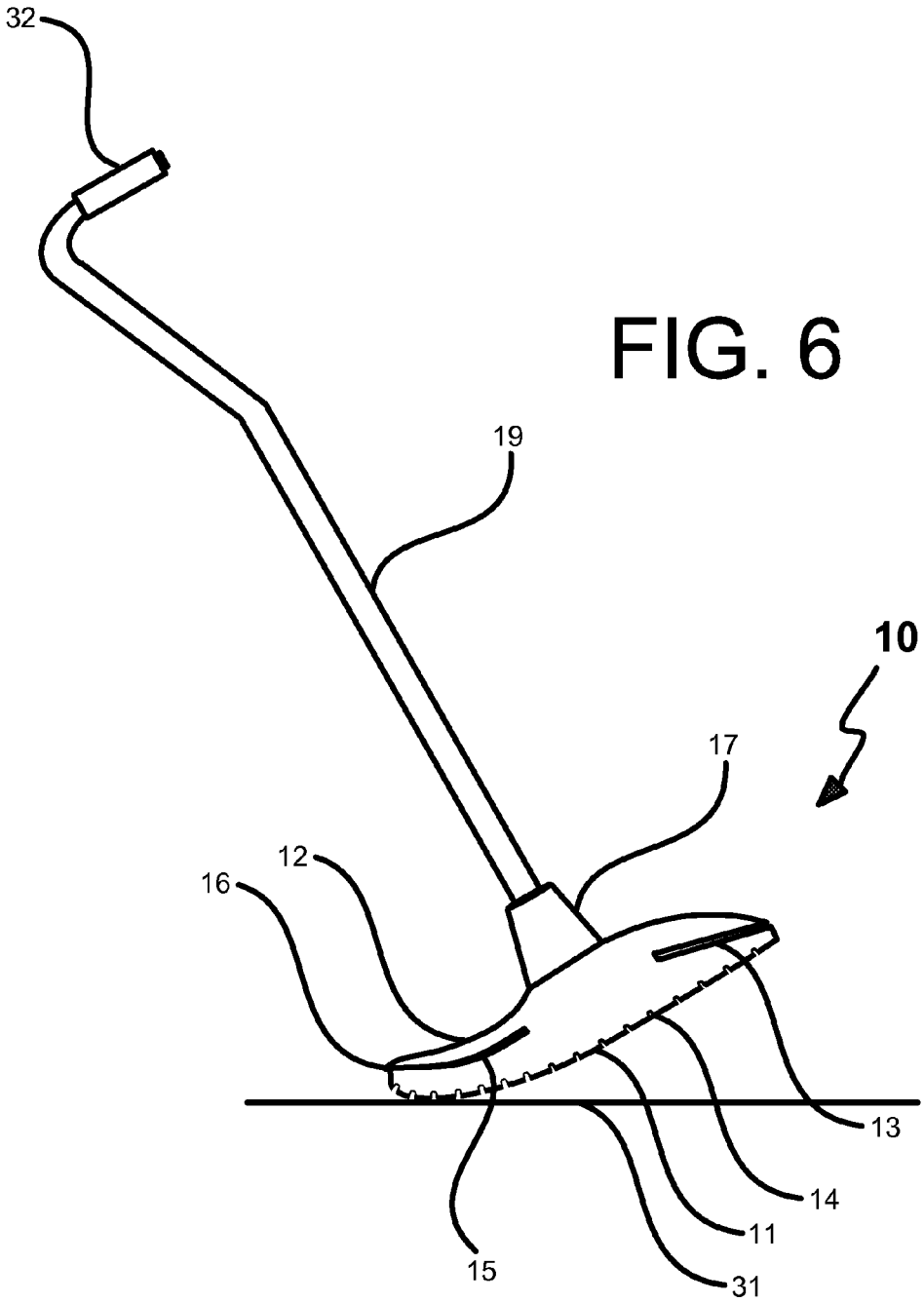
FIG. 6 is a side view of the installed walking aid support in use according to the first embodiment of the present invention.
Figure 7:
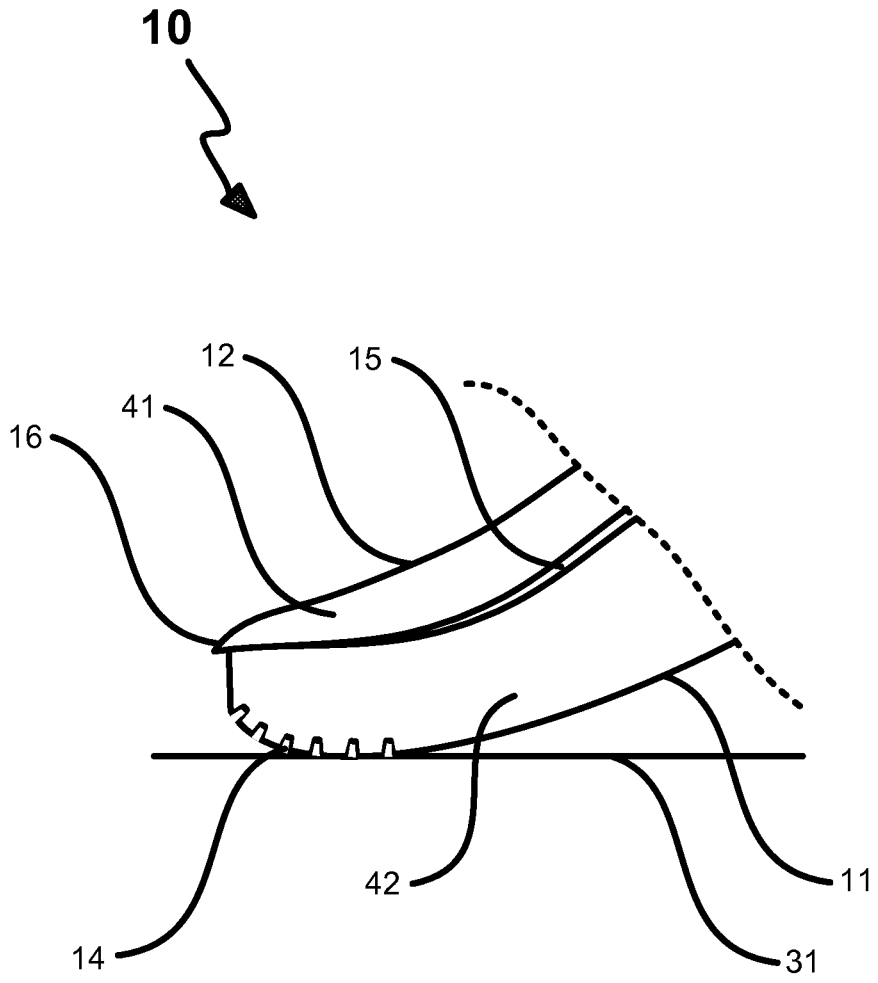
FIG. 7 is a magnified side view of a front portion of the installed walking aid support according to the first embodiment of the present invention.
Figure 8:
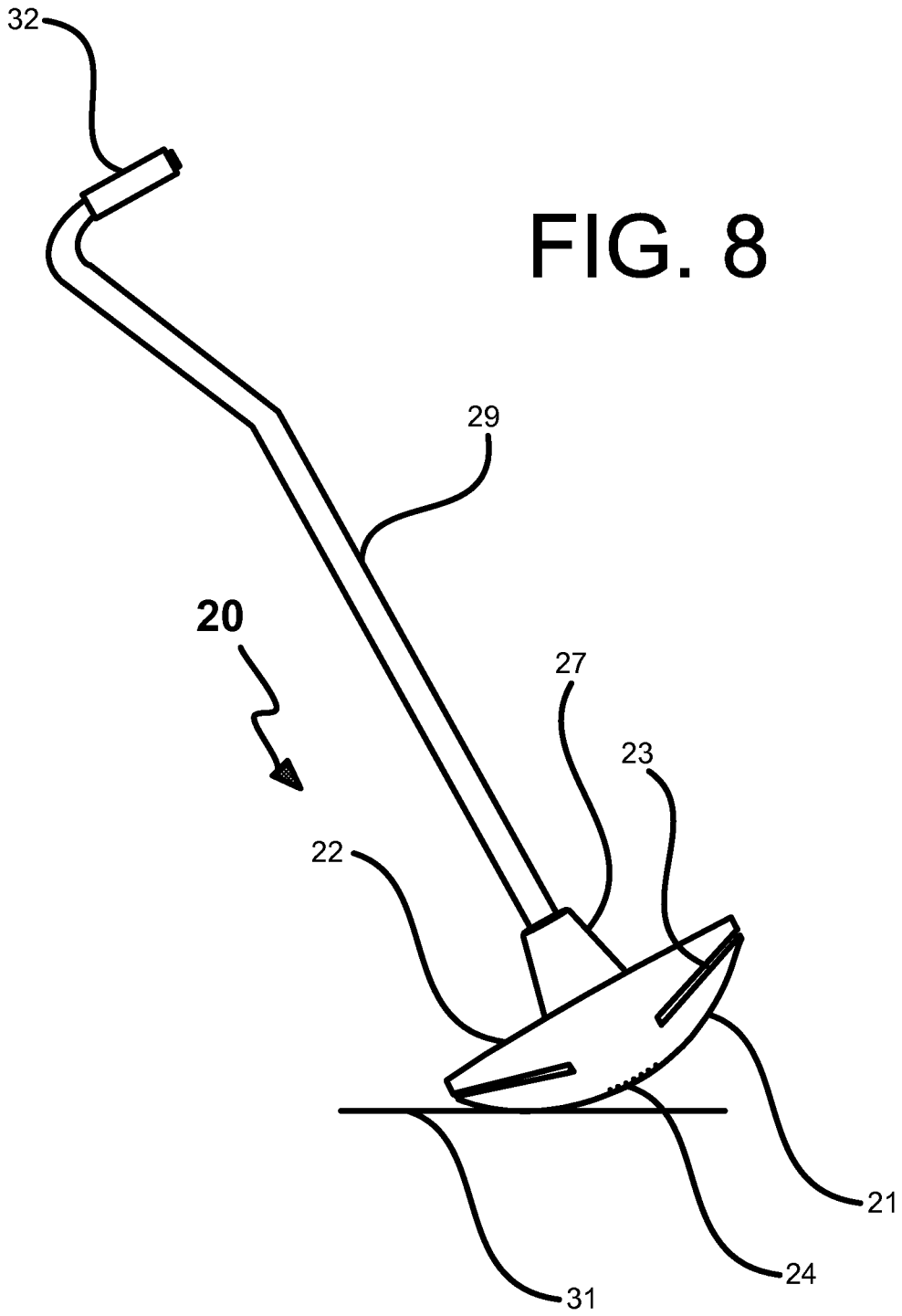
FIG. 8 is a side view of the installed walking aid support in use according to the second embodiment of the present invention.

In the course of walking, a handicapped person may bend forward and tilt the rod 19 forward while the support block 10 is disposed on the walking terrain 31 as shown in FIG. 6. Tilting the rod 19 forward causes the front portion of the support block 10 to stretch and contort as shown in FIGS. 6 and 7. Tilting the rod 19 while the support block 11 rests on the ground and the person walking leans on it for support in the course of walking also causes the following changes:

1. The threads on the bottom of the support block open and expand providing enhanced surface friction.
2. The upper section 41 of the support block is forced downward onto the lower section 42 and forward in the direction of walking. The forces exerted on the support block by the person leaning on it at an angle cause the upper portion of the support block to slide forward along the slit forming a lip 16 that extends beyond the lower portion of the support block 10 as shown in FIGS. 6 and 7. Thus, the downward force further enhances the stability of the support block 10 making it less susceptible to slippage.

Figure 3:
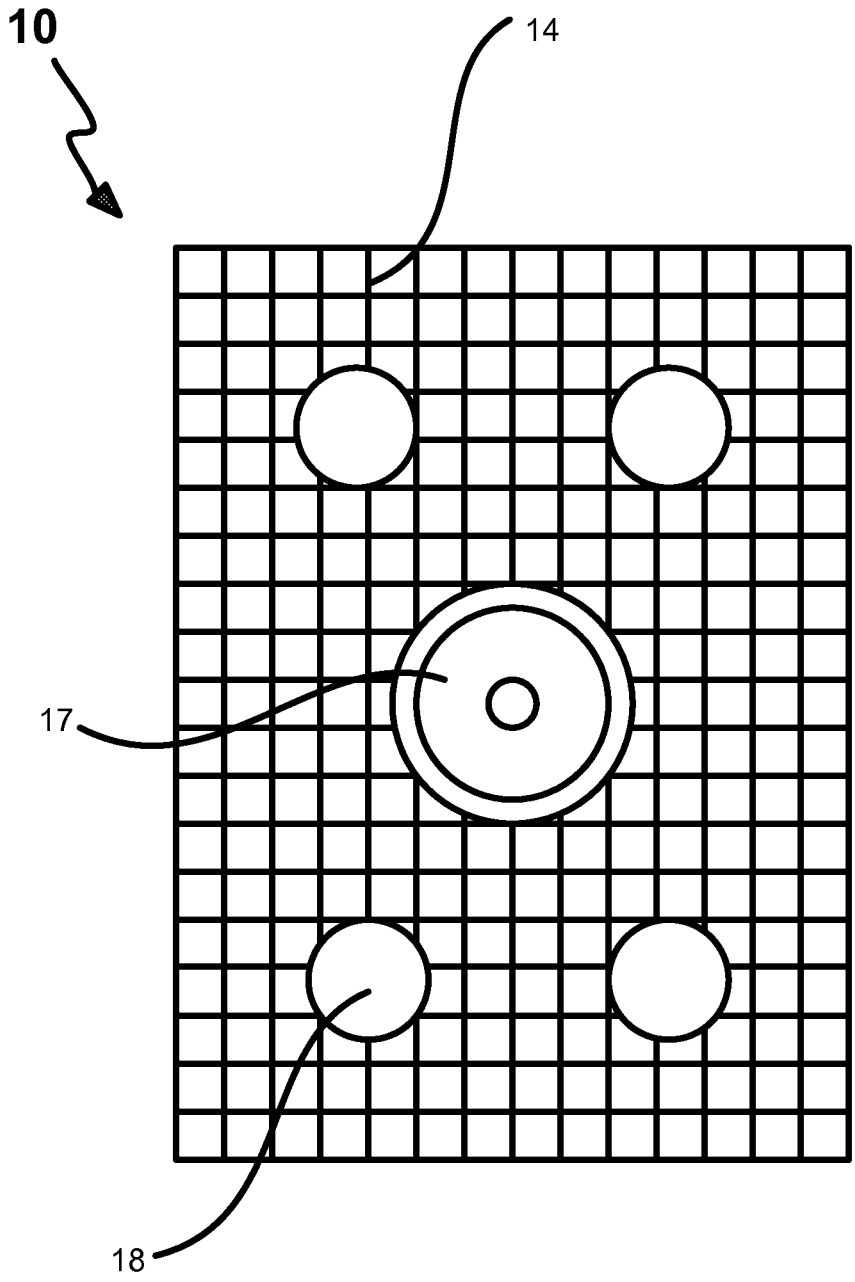
FIG. 3 is a bottom view of the walking aid support according to the first embodiment of the present invention.
Figure 4:
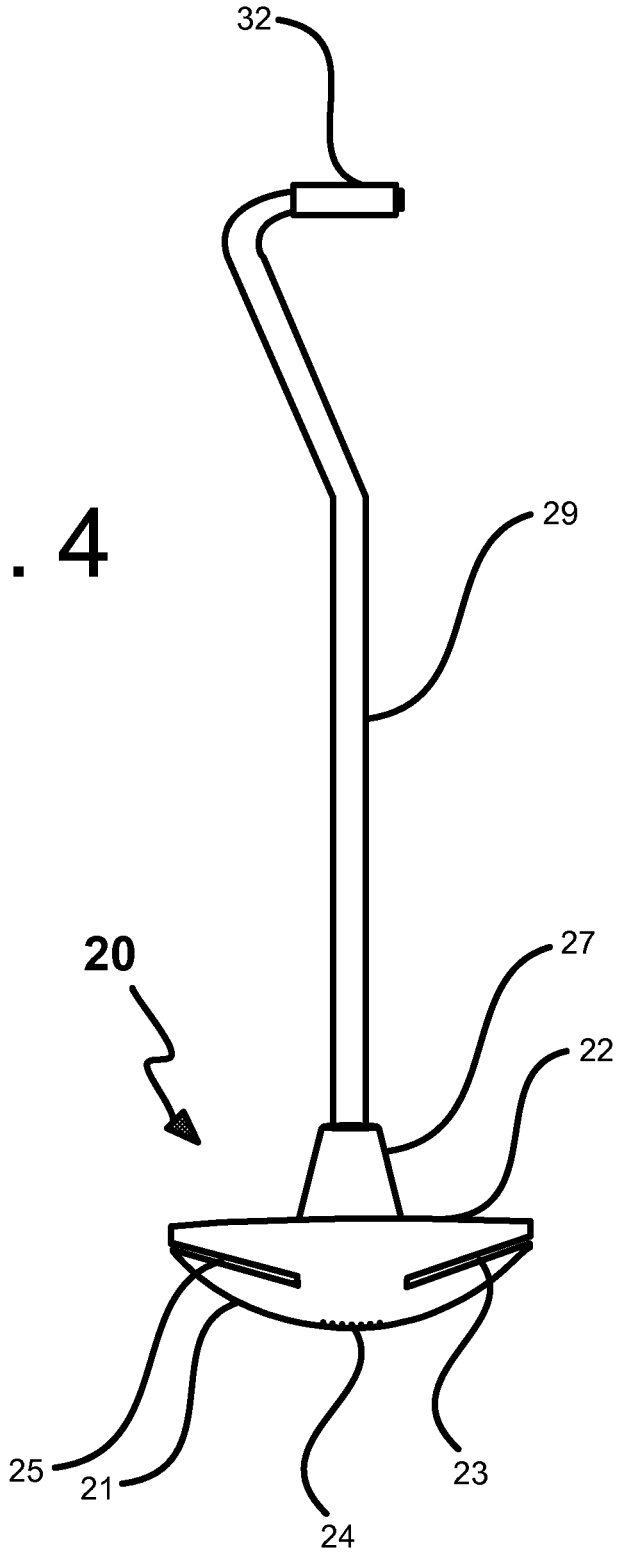
FIG. 4 is side view of the installed walking aid support according to the second embodiment of the present invention.
Figure 5:
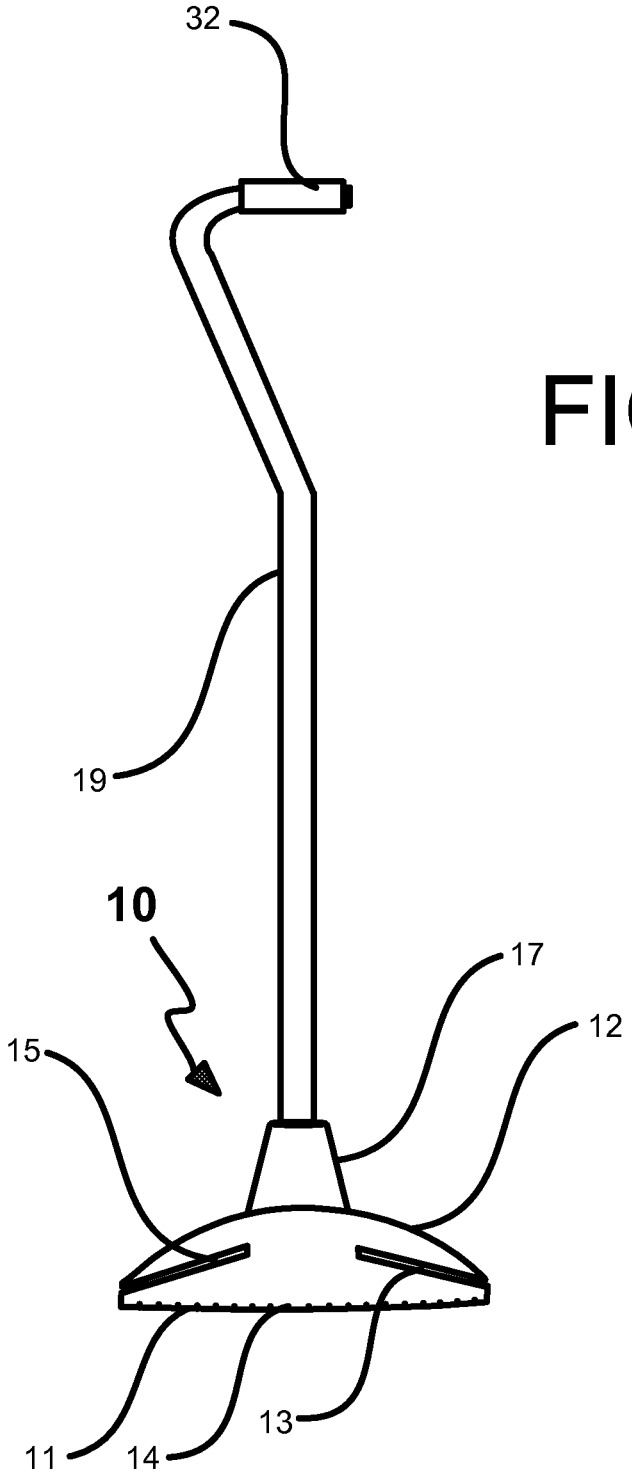
FIG. 5 is a side view of the installed walking aid support according to the first embodiment of the present invention.
Figure 9:
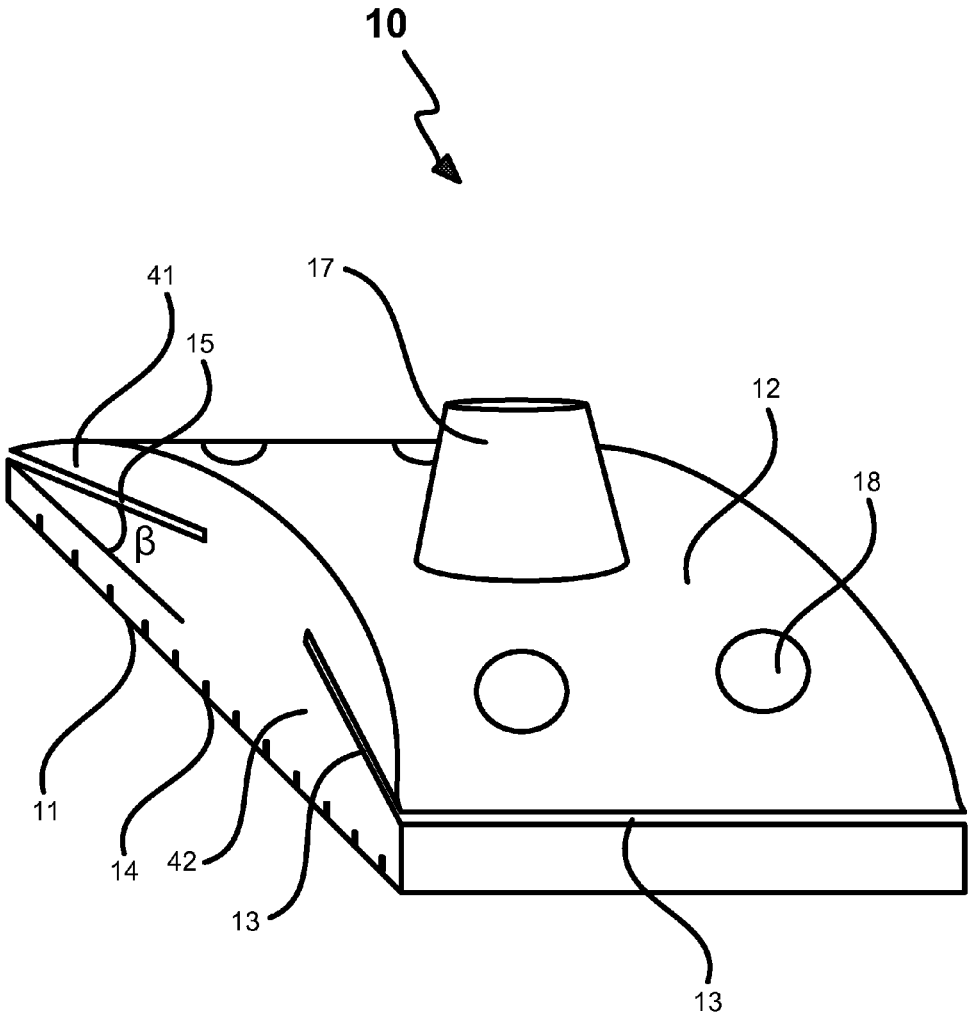
FIG. 9 is a side and rear perspective view of a walking aid support according to the first embodiment of the present invention.

The support block 10 may further comprise apertures 18 that permeate the support block 10 from the top 12 to the bottom 11 as shown in FIGS. 3 and 9. The apertures may be used to control the weight of the support block 10 and further reduce the likelihood of slippage as objects on the ground protrude into the apertures 18. FIGS. 3 and 9 show four apertures 18; however the number of apertures may vary from 1-8.

The support block 10 may also contain a rear side slit 13 that mirrors the front side slit 15. The rear side slit 13 provides enhanced friction and thus enhanced stability in a situation where, for example, the handicapped person slips forward and instinctively tilts the walking aid rod rearward in an attempt to regain balance and support. The enhanced stability mechanism in this scenario occurs much in the same manner as with the mechanism for enhanced frontal stability.

The second embodiment of the present invention is designed for producing less friction and is therefore less restricting compared to the first embodiment. This embodiment is therefore generally appropriate for persons with mild or no handicap but who occasionally prefer to have some support handy while walking. In general, the second embodiment uses the support block of the first embodiment flipped upside down.

Figure 2:
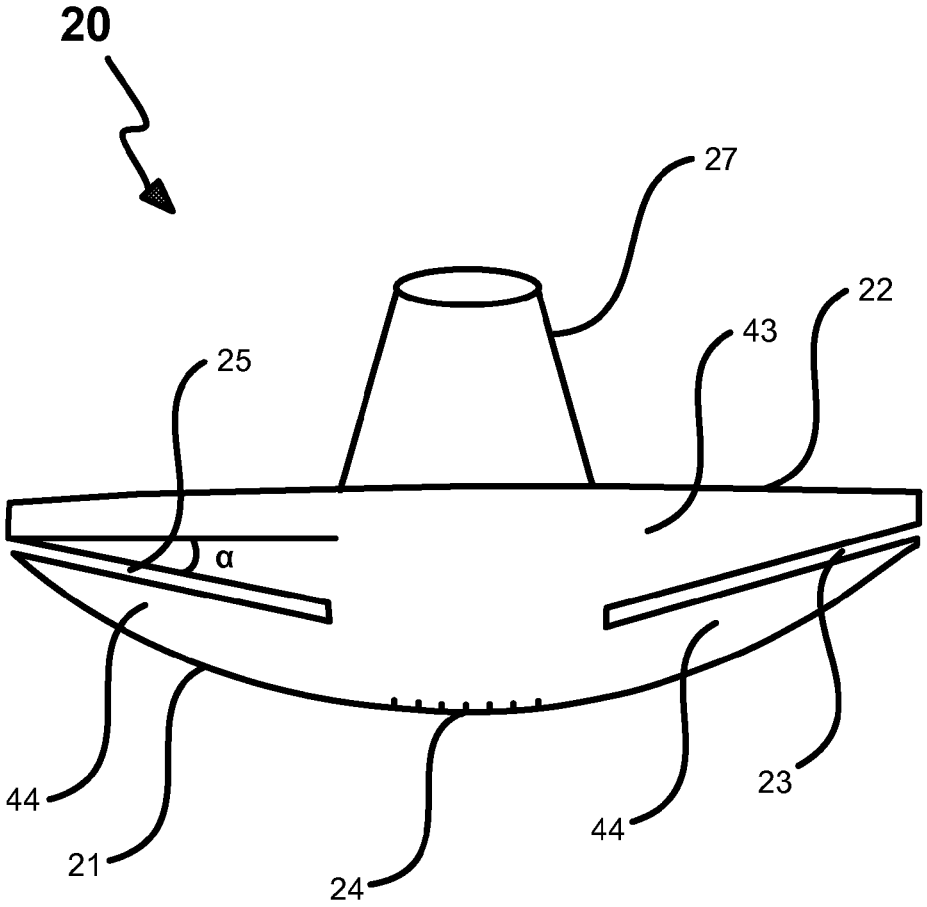
FIG. 2 is a side view of a walking aid support according to a second embodiment of the present invention.
Figure 10:
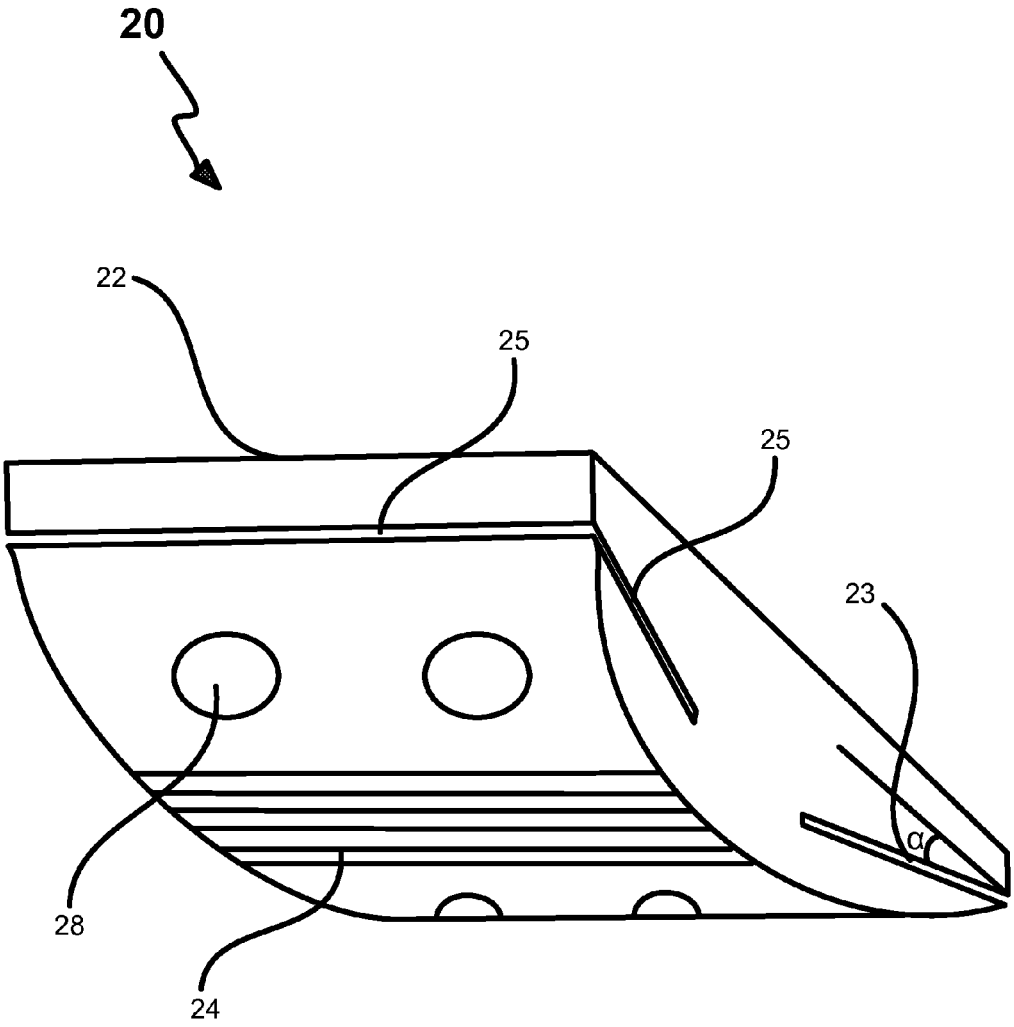
FIG. 10 is a side and bottom perspective view of a walking aid support according to the second embodiment of the present invention.

The support block 20 of this embodiment has a substantially oval or semi-elliptical shaped bottom 21 and substantially flat top 22. A first slit 25 is positioned at the front side of the support block 20. The slit is angled downward at an angle $\alpha$ ranging from about 10 degrees to about 25 degrees and preferably from 15 degrees to about 20 degrees as shown in FIGS. 2 and 10. An optional second slit 23 is positioned at the rear side of the support block 20. As with the first embodiment of the present invention, each slit divides the support block 20 into an upper section 43 and a lower section 44. In this embodiment the lower section 44 is more flexible than the upper section 43 making it easier to roll over obstacles on the walking terrain 31. This embodiment is thus better suited for facilitating walking and providing support in rough terrain while the first embodiments is better suited for providing support on slippery terrain 31.

The bottom of the support block 20 may contain threads 24. A tip 27 is affixed to the top 22 of the support block 20 for attaching a rod 29 having a handle. As with the first embodiment, the support block 20 may comprise apertures 28 permeating from top 22 to the bottom 21.

It should be understood, of course, that the foregoing relates to exemplary embodiments of the invention and that modifications may be made without departing from the spirit and scope of the invention.

We claim:

1. A walking aid support adapted for attachment to a rod of a cane, a crutch or a walker, said walking aid support comprising:

a front side and a rear side;

a substantially flat bottom having a rectangular shape for engaging a walking ground, said bottom of the walking aid support comprising longitudinal and cross direction threads;

a substantially semi-elliptical top; and a front side slit disposed in the front side of said walking aid support, said front side slit angling upward to form a first acute angle relative to the flat bottom, said front side slit forming a gap of a predetermined width, said front side slit also forming a division between an upper section and a lower section of the front side of the support; and wherein said upper section of the front side slit of the support forms a first lip protruding out of the front side of the walking aid support, in the course of tilting the rod forward from an upright position as the walking aid support engages the ground, wherein the upper section of the walking aid support front side slit moves forward and downward toward the front side of the walking aid support and slides along the gap formed by the front side slit in a manner as to exert pressure onto the lower section of the walking aid support front side, said rear side of the support being configured to pivot upward and said front side of the walking aid support being configured to contort in a manner as to widen the threads disposed at the bottom of the front side of the walking aid support, said first lip being disposed on top of the lower section adapted to be substantially parallel with the walking ground when the rod is tilted forward.

2. The walking aid support of claim 1, wherein the upper section of the front side slit has a thickness of between about 20 percent and about 40 percent of a thickness of the lower section of the front side slit and wherein the front side slit forms the first acute angle of between about 10 degrees and about 25 degrees relative to the flat bottom.

3. The walking aid support of claim 1 further comprising a rear side slit disposed in the rear side of said walking aid support, said rear side slit angling upward to form a second acute angle relative to the flat bottom, said rear side slit forming a gap of a predetermined width, said rear side slit also forming a division between an upper section and a lower section of the rear side of the support, wherein the upper section of the rear side slit of the support forms a second lip protruding out of the rear side of the walking aid support in the course of tilting the rod rearward from the upright position as the walking aid support engages the ground, wherein the upper section of walking aid support rear side slit moves rearward and downward toward the rear side of the walking aid support and slides along the gap formed by the rear side slit in a manner as to exert pressure onto the lower section of the walking aid support front side; said front side of the support being configured to pivot upward and said rear side of the walking aid support being configured to contort in a manner as to widen the threads disposed at the bottom of the rear side of the walking aid support, said second lip being disposed on top of the lower section and adapted to be substantially parallel with the walking ground when the rod is tilted rearward.

4. The walking aid support of claim 3, wherein the upper section of the rear side slit has a thickness of between about 20 percent and about 40 percent of a thickness of the lower section of the rear side slit and wherein the rear side slit forms the second acute angle of between about 10 degrees and about 25 degrees relative to the flat bottom.

5. The walking aid support of claim 1 further comprising a tip disposed on the semi-elliptical top for attaching the rod, said rod containing a handle.

6. The walking aid support of claim 5 further comprising at least one aperture disposed in the walking aid support, said aperture spanning from the top to the bottom of the walking aid support.

7. The walking aid support of claim 6, wherein there are four apertures disposed in the walking aid support.

* * * * *